United States Patent [19]

Carlson

[11] 4,310,318

[45] Jan. 12, 1982

[54] ELECTRONIC GAME

[75] Inventor: Albert W. D. Carlson, Roosevelt Island, N.Y.

[73] Assignee: Rivercross Learning Corp., Roosevelt Island, N.Y.

[21] Appl. No.: 188,076

[22] Filed: Sep. 17, 1980

[51] Int. Cl.[3] ..... G09B 7/00

[52] U.S. Cl. ..... 434/339; 273/1 E; 339/17 C

[58] Field of Search ..... 273/1 E, 237; 434/327, 434/339; 339/17 C, 95 B, 152, 147 R, 147 C, 147 P, 228, 256 RT

[56] References Cited

U.S. PATENT DOCUMENTS

| | | | |
|---|---|---|---|
| 2,997,793 | 8/1961 | Kelly | 434/339 |
| 3,763,574 | 10/1973 | Rose | 434/339 |
| 3,800,437 | 4/1974 | Lamberson | 434/339 |
| 3,947,978 | 4/1976 | Clark et al. | 434/339 |
| 4,020,430 | 4/1977 | Uander Heyden | 333/79 |
| 4,024,953 | 5/1977 | Nailor | 206/344 |
| 4,229,686 | 10/1980 | Mullersman et al. | 320/2 |

*Primary Examiner*—Richard C. Pinkham
*Assistant Examiner*—Leo Picard
*Attorney, Agent, or Firm*—Darby & Darby

[57] ABSTRACT

An electronic game made from a single piece of material on which conductive ink is printed on a first section of the piece with a pattern of two sets of closely adjacent lines each with a connecting terminal for one terminal of a battery. On the first section, a light emitting diode is mounted which is connected in series with one set of lines and one of the battery connecting terminals. A hole is provided in the second section of the piece through which the light emitting diode can be viewed and an overlay with electrically conductive areas thereon is cut from the second section. The two sections of the piece are folded together with the battery connections from the first section extending through slots in the second section and a battery is connected to the battery connections with the light emitting diode being viewable through the opening. When pressure is applied to surface of the overlay, a connection is made between the two sets of lines, the circuit is completed and the light emitting diode is illuminated.

11 Claims, 3 Drawing Figures

ELECTRONIC GAME

Various types of electronic games are well known. One type of electronic game includes a microprocessor and various switches which are actuated to achieve a visual or audible response. Another type of game includes a light producing device, such as a light emitting diode (LED) which is moved across a panel by various controls. Generally, such games are relatively expensive and require complex parts such as molded cases, complex electronics, programming of a microprocessor, computer memory, etc.

Heretofore, a type of amusement device has been proposed wherein two sets of electrically conductive lines are laid down on a substrate. The two sets of lines are connected to a power supply and also to some type of a response device such as a light or buzzer, or an electronic circuit. A separate overlay is provided which is of a deformable type with a number of conductive areas on its lower surface. When the overlay is placed on the substrate and depressed in the appropriate spot, a connection is made between the two sets of lines and the response device is energized. Typical of such amusement devices are, for example, in the U.S. Pat. No. 3,763,574 to Rose and No. 3,795,989 to Greenber.

The amusement devices of these patents are still somewhat complex in that they require some type of a holder for the substrate and the overlay, a relatively complicated overlay, electronic circuits for energizing the response device, terminals for the battery and power supply, etc.

The present invention is directed to a novel and economical game which, in large measure, is formed from a single piece of material having all of the requisite parts printed as patterns of conductive lines and battery terminals thereon in a simple manner. In accordance with the invention, a single piece of material, such as paper, cardboard or plastic, is provided on which is printed with a suitable electrically conductive ink, two sets of lines as well as terminals for a battery. One of the sets of lines is electrically connected to one of the battery terminals. A part is die cut, or scored, out of the piece of material to form an overlay and electrically conductive areas are formed on this overlay either during the original printing step or at some later time. A response device in the form of a light emitting diode (LED) is connected between the other of the two sets of lines and to the other battery terminal and an opening is provided in the piece of material through which light emitting diode can be seen. The game is assembled by folding the piece of material at a predetermined place to place the LED in the opening and connecting the battery to the terminals. The two sets of lines are located in the window from which the overlay was cut and the overlay is placed in the window. When the conductive area on the overlay is brought into contact with the two sets of lines, the circuit is completed to energize the LED.

It is therefore an object of the present invention to provide a simplified electronic game which can be reproduced in an efficient and economical manner.

A further object is to provide an electronic game in which the electronic circuitry, including the terminals for a battery which is to be used as a power supply, is laid down by a printing or other similar process.

An additional object is to provide a novel electronic game which is formed principally from a sheet of material, containing the battery terminals as well as the necessary wiring pattern and overlay to actuate the electrical circuitry.

Other objects and advantages of the present invention will become more apparent upon reference to the following specification and the annexed drawings in which.

Figure 1:
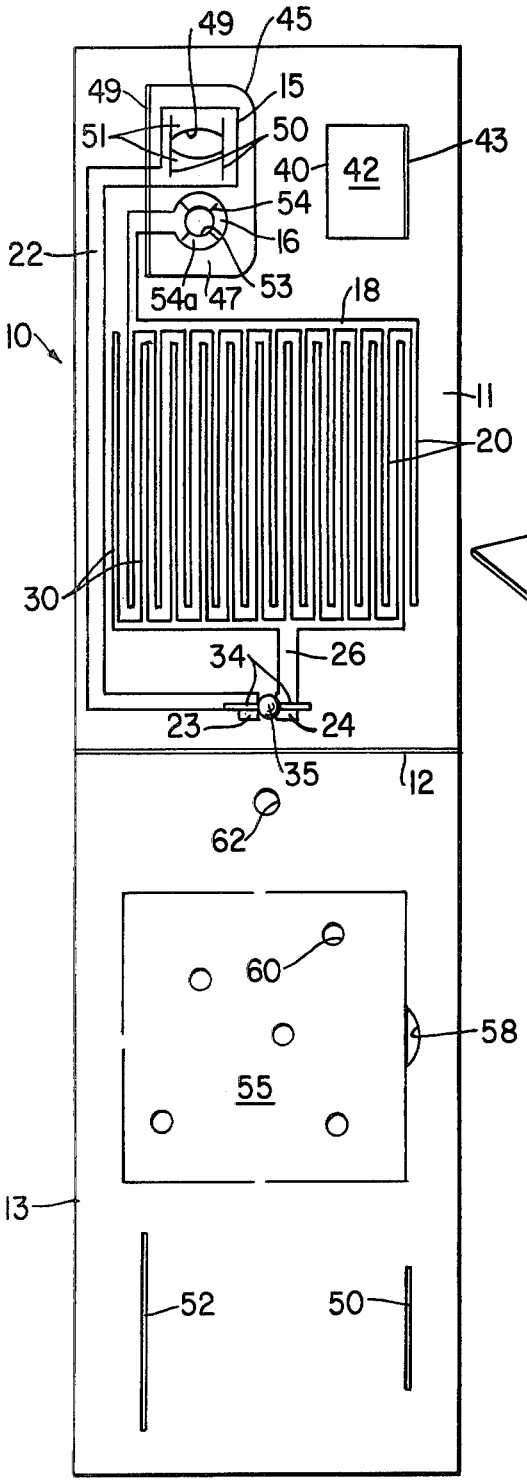
FIG. 1 is a plan view of the sheet of material having the wiring pattern printed thereon.
Figure 2:
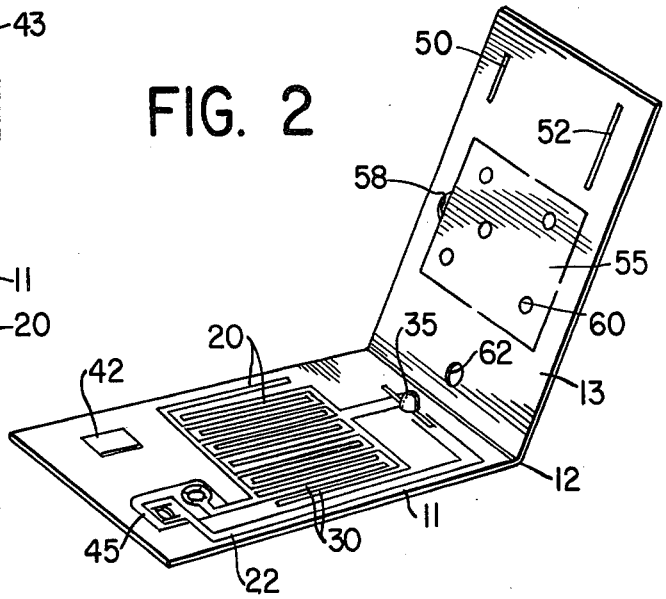
FIG. 2 is a perspective view showing the game after assembly of the LED.
Figure 3:
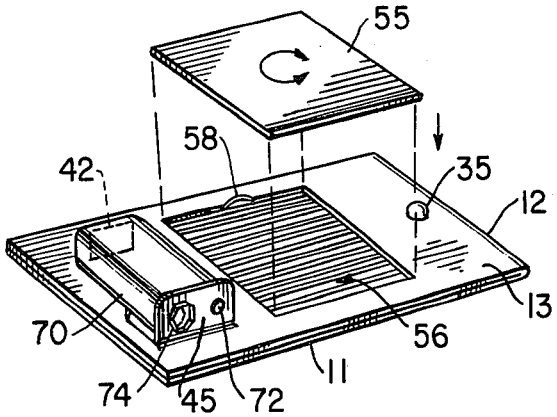
FIG. 3 is a perspective view showing the fully assembled game with the battery.

Referring to the drawings, the game is formed on a single sheet of material 10, such as, for example, paper, cardboard or plastic, having the shape of an elongated rectangle. Any other suitable shape can be used, for example, a square, circle, or other configuration. Piece 10 is divided into two parts 11 and 13 which are foldable about a center line 12.

There is laid down on the section 11, by a suitable printing process, such as by offset lithography, rotorgravure or silk screening, or other similar process a pattern of electrically conducting ink which forms the electrical wiring for the game. Any suitable electrically conductive ink can be used, for example, those of the aluminum oxide type or graphite impregnated inks. All of the conductive ink printing is on the same side of piece 10 so that it can be laid down in a single pass. The pattern of electrically conductive ink includes a generally rectangular area 15 which forms one contact for connection to one terminal of a battery and a generally circular area 16 which forms the other contact for connection to a second terminal of the battery. The exact shape of areas 15 and 16 is not critical but sufficient area is provided to make good electrical contact with the battery terminals.

The conductive ink pattern also includes a branch line 18 which extends from the contact area 16 into a downwardly extending comb of lines 20. A second branch line 22 extends downwardly from the contact area 15 along section 11 toward the center fold line 12 and then inwardly toward the center where it widens into a first LED terminal pad 23. There is then an open space and thereafter a second LED terminal pad 24. From the second terminal pad 24 a line 26 extends upwardly and branches out into a second, upwardly extending comb of lines 30. The teeth of the two combs of lines 20 and 30 are inter-fitting but they do not touch.

The two contact tabs 34 of an LED 35 are electrically connected and the LED is located between the LED terminal pads 23, 24 for example, by stapling, soldering, or taping the tabs 34 to pads 23, 24 or by taping down the LED with a piece of pressure sensitive or transparent adhesive tape so that the tabs 34 contact pads 23, 24.

Section 11 of piece 10 has a number of scored or die cut areas. The first of these is cut along three sides at 40 to define a battery holder tab 42 which can be bent about a line 43. A three-sided cut 45 is also made around the two battery terminal areas 15 and 16 to form a tab 47 which can be folded about a line 49.

The first battery contact area 15 has an elliptical cut-out 49 with cuts 50 made along the ends thereof to form two tabs 51. The second battery contact area 16 has a circular cut-out 53 and a plurality of radially extending cuts 54 to form a plurality of flaps 54*a*.

In the second section 13, two slots 50 and 52 are cut, these slots having a length corresponding to the length of the battery holder tab 42 and the battery terminal tab 47. Slots 50, 52 are only slightly wider than the thickness of piece 10 which determines the thickness of tabs 42, 47. A central area 55, which is preferably square or of some other symmetrical shape, e.g. circular, polygonal, etc., is also cut, or partially scored, leaving a window 56. The cut out area 55 is used as the overlay. If desired, there can be printed at the time of printing the various lines of the section 11 one or more conductive actuating areas 60 which are of a width sufficient to bridge the space between and to electrically connect two adjacent lines of the combs 20 and 30.

An opening 58 is cut adjacent the window 56 to permit a fingernail, pencil, or pen point, to be inserted to pry up the overlay 55. An opening 62 is also cut in section 13 of a size sufficient for the head of the LED to extend therethrough or for the LED to be viewed through the opening.

If desired, the opposite side of the piece 10 from that having the conductive pattern has printed thereon instructions, designs, a game board, etc. or any other suitable information.

The general process of manufacturing, assembling and use of the device is described below. First, the circuits are printed by a suitable offset lithography, rotogravure and/or silk screen or other similar process on one side of section 11 as previously described. If used, the game design instructions are printed on the opposite side of one or both of the sections 11 and 13, this also being done by a conventional printing process. The printed material on the obverse side of the piece 10 can be of any nature, for example, the layout of a football field, a baseball field, a yes or no question and answers, etc.

The piece 10 is then die cut or subjected to some other suitable process to form the various tabs, slots and overlay, as previously described. As previously described, the overlay 55 can be fully cut out or only partly scored. The LED is then inserted and connected to the two contact pads 23,24.

The piece can be folded about the line 12 so that it can be shipped in a substantially flat condition. If the LED has a head, it will extend through opening 62.

When the player gets the game, he or she merely unfolds the sections 11 and 13 about the line 12 and bends the battery holder and battery tabs 42 and 47 upwardly from the position shown in FIG. 1. The tabs 42 and 47 are then inserted through the slots 50 and 52 and the two sections 11 and 13 are placed against each other. Since the hinge lines of the tabs 42,47 are formed during the initial upward bending, the tabs will tend to move inwardly toward each other unless they are initially bent by more than 90°.

A battery 70 is then placed between the tabs 42 and 47. The battery 70 is shown as a conventional 9 volt battery. Tab 42 is of a height sufficient to lock under one of the rolled edges generally found on the bottom of the battery case. The terminals 72 and 74 of the battery are forced through the respective holes 50 and 53 cut in the two contact areas 15 and 16 of the battery tab terminal 47. The flaps 51 and 54*a* which are provided around the holes 50, 53 terminal areas 15 and 17 make electrical contact with battery terminals 72, 74. In this manner, electrical current is provided to the circuit, but the circuit is not completed.

The player then removes the overlay 55 from section 13 by inserting is fingernail or other device into the opening 58. He then can rotate the overlay 55 to scramble where the dot pattern 60 is located. Using a symmetrical overlay permits the dot pattern to be effectively reprogrammed as it is rotated. The overlay is placed in the opening and finger pressure applied at various points. If a dot bridges two of the lines then a connection will be made between two lines of the two combs 20 and 30. This completes the electrical circuit between the two terminals 72,74 of the battery and the LED causing the LED to light.

If an AA, C or D type battery is used, one of the contact areas 15 would be placed on one of the tabs 42,47 and the other contact area 16 on the other tab.

It should be understood that a novel and simplified electronic game is provided which can be made in a relatively simple matter and at a relatively low cost. The major steps required are printing, die cutting and insertion of the LED. The game can be made small, it can be easily shipped and transported and, due to its low cost, can be used as a novelty or premium item.

What is claimed is:

1. An electronic game comprising:
a piece of material,
a pattern of electrically conductive ink is laid down on one side of said piece, said pattern having two combs of lines with interfitting teeth,
a pair of battery contact areas, a first line connecting one of the combs to one of the battery contact areas and a second line with a break connecting the other comb to the other battery contact area,
a response device electrically connected to the second line across the break,
said piece being cut to permit the portion having the battery terminal contact areas to be bent upwardly and said piece being formed with a slot through which the upwardly bent portion extends when the piece is folded.

2. A electronic game as in claim 1 further comprising an overlay cut from the piece in the area opposing the two combs of lines when the piece is folded, said overlay adapted to have conductive material at at least one area thereof which when pressed against the lines of the two combs of lines, electrically connects the two combs of lines to complete the circuit to the two battery contact areas.

3. An electronic game as in claim 1 wherein the response device comprises light emitting means.

4. An electronic game as in claim 1 wherein an opening is cut in the piece opposite the break in the second line across which the light emitting means is connected to permit the light emitting means to be viewed when the piece is folded.

5. An electronic game as in claim 1 wherein both said battery terminal contact areas are located on the same portion which can be upwardly bent, said portion being formed with a hole in each of said battery terminal contact areas through which the respective terminals of the battery extend.

6. An electronic game is in claim 5 wherein the piece is cut to form a second portion which can be upwardly bent, said piece being formed with a second slot through which the upwardly bent second portion extends, said second portion adapted to engage the battery.

7. An electronic game as in claim 3 wherein said light emitting means comprises a light emitting diode, the connecting leads of said light emitting diode electrically connected to the ends of the second line at the break.

8. An electronic game as in claim 7 wherein the leads of the light emitting diode are connected to the ends of the second line by soldering.

9. An electronic game as in claim 7 wherein the leads of the light emitting diode are connected to the ends of the second line by an adhesive.

10. An electronic game as in claim 2 further comprising an opening cut in the piece adjacent the area where the overlay is located to provide access for removing the overlay.

11. An electronic game as in claim 2 wherein said overlay is of generally symmetrical shape to permit the conductive material in the area therein to be located at different places relative to said pattern on said one side of said one piece.

* * * * *